US009801485B2

(12) United States Patent
Snow et al.

(10) Patent No.: US 9,801,485 B2
(45) **Date of Patent: *Oct. 31, 2017**

(54) COLLAPSIBLE HANGER FOR USE IN-GARMENT TO REDUCE CREASING, CRUSHING, AND WRINKLING, WHILE MAINTAINING SUPPORT AND STRUCTURE, OF UPPER GARMENT DURING STORAGE AND TRANSPORTATION

(71) Applicant: Brad Alan Snow, Atlanta, GA (US)

(72) Inventors: Brad Alan Snow, Atlanta, GA (US); Michael Patrick Carey, Pembroke Pines, FL (US)

(73) Assignee: Brad Alan Snow, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/209,009

(22) Filed: Jul. 13, 2016

(65) Prior Publication Data

US 2017/0071386 A1 Mar. 16, 2017

Related U.S. Application Data

(63) Continuation-in-part of application No. 14/853,448, filed on Sep. 14, 2015, now Pat. No. 9,687,099.

(51) Int. Cl.
*A47G 25/40* (2006.01)

(52) U.S. Cl.
CPC .... *A47G 25/4038* (2013.01); *A47G 2200/106* (2013.01)

(58) Field of Classification Search
CPC ..... A47G 25/4038
See application file for complete search history.

(56) References Cited

U.S. PATENT DOCUMENTS 863,236 A * 8/1907 Sundin ..... A47G 25/4038 223/89
881,818 A * 3/1908 Morrison ..... A47G 25/4038 15/105

(Continued)

FOREIGN PATENT DOCUMENTS

| | | |
|---|---|---|
| WO | 9818371 | 5/1998 |
| WO | 9846107 | 10/1998 |
| WO | 0121048 | 3/2001 |

*Primary Examiner* — Shaun R Hurley
*Assistant Examiner* — Andrew W Sutton
(74) *Attorney, Agent, or Firm* — Fleit Gibbons Gutman Bongini Bianco PL; Jose Gutman

(57) ABSTRACT

A collapsible hanger includes a left arm, a right arm, and a hook. A hinge rotatably holds the left and right arms together. When in expanded state, the left and right arms extend opposite each other. When in collapsed state, the arms are rotated adjacent to each other. The hook is rotatably coupled to one of the arms in a ball and socket arrangement, and rotatable around the ball and socket arrangement between first and second positions. In the first position, the hook curved end is located above a top side of the respective arm. In the second position, the hook curved end is rotated into an opening and recess in the respective arm. A pin holding the hinge together includes a curved end portion overhanging an outer surface of the hinge to form a clasp to hold a collar of a garment.

20 Claims, 17 Drawing Sheets

(56) References Cited

U.S. PATENT DOCUMENTS 1,059,649 A * 4/1913 Wallace ..... A47G 25/4038 223/89
1,836,935 A * 12/1931 Orkin ..... A47G 25/4038 223/89
1,836,942 A * 12/1931 Sumi ..... A47G 25/4038 15/160
2,425,527 A * 8/1947 Gaudino ..... A47G 25/4038 223/94
2,478,590 A * 8/1949 McKnelly ..... A47G 25/4038 137/512.2
2,544,170 A * 3/1951 Mills ..... A47G 25/4023 223/89
4,300,688 A * 11/1981 London ..... A47G 25/36 206/285
4,624,396 A * 11/1986 Universe ..... A47G 25/1407 206/281
4,669,642 A * 6/1987 Nicholas ..... A47G 25/14 211/118
5,085,357 A * 2/1992 Chen ..... A47G 25/4038 223/85
5,154,329 A * 10/1992 Dorfmueller ..... B65D 85/182 206/292
5,566,843 A * 10/1996 Kruska ..... A47G 25/065 211/1.3
5,687,888 A * 11/1997 Chang ..... A47G 25/4038 223/85
5,813,578 A * 9/1998 Hsieh ..... A47G 25/4061 223/85
5,893,493 A * 4/1999 Noiray ..... A47G 25/4061 223/89
6,328,187 B2 * 12/2001 Sugita ..... A47G 25/403 223/85
D508,614 S * 8/2005 Colon ..... D6/318
7,185,795 B1 * 3/2007 Wallick ..... A47G 25/4023 223/89
7,237,702 B2 * 7/2007 Landis ..... A47G 25/4023 223/89
7,243,823 B2 * 7/2007 Cresap ..... A47G 25/4023 223/85
7,784,654 B1 * 8/2010 Mercado ..... A47G 25/4038 223/89
8,113,393 B2 * 2/2012 Ho ..... A47G 25/32 223/85
2008/0283558 A1 * 11/2008 Rude ..... A47G 25/32 223/94

* cited by examiner

COLLAPSIBLE HANGER FOR USE IN-GARMENT TO REDUCE CREASING, CRUSHING, AND WRINKLING, WHILE MAINTAINING SUPPORT AND STRUCTURE, OF UPPER GARMENT DURING STORAGE AND TRANSPORTATION

CROSS-REFERENCE TO RELATED APPLICATION

This application is a continuation-in-part of prior pending U.S. patent application Ser. No. 14/853,448, filed on Sep. 14, 2015, the entire disclosure of which being herein incorporated by reference in its entirety.

FIELD OF THE DISCLOSURE

The present disclosure generally relates to garment hangers, and more particularly to a collapsible garment hanger suitable for use in garment during garment storage.

BACKGROUND

A crisp, clean, wrinkle-free, and crease-free shirt collar and jacket collar are important to many people, such as professionals and fashionistas. Unfortunately, when a shirt or suit is stored, even for a short time, in an enclosure, drawer, bag, carrying case, or the like, it often becomes wrinkled, creased, and/or crushed, degrading the structure, e.g., the shoulders padding, the collar, etc. Particularly, the material of the collar and upper shoulder area in a garment tends to degrade and lose its shape and structure contributing sagging, dimpling of shoulders including wrinkling and creasing. This results in an unsightly and potentially unwearable garment.

There has been a long felt need for maintaining and transporting stored garments, such as shirts, suits, and jackets, as wrinkle-free, crease-free, and with maintained intended garment shape and structure, as possible for subsequent use.

BRIEF DESCRIPTION OF THE DRAWINGS

The accompanying figures in which like reference numerals refer to identical or functionally similar elements throughout the separate views, and which together with the detailed description below are incorporated in and form part of the specification, serve to further illustrate various embodiments and to explain various principles and advantages all in accordance with the present disclosure, in which.

DETAILED DESCRIPTION

Figure 1:
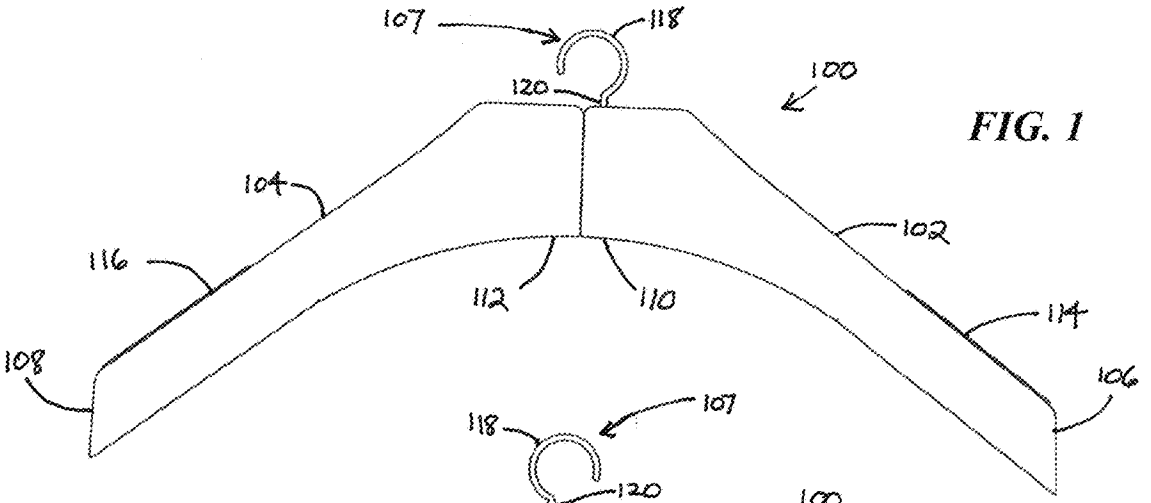
FIG. 1 is a front-side view of an example collapsible hanger, according to various embodiments of the present disclosure.

As required, detailed embodiments are disclosed herein; however, it is to be understood that the disclosed embodiments are merely examples and that the devices, structures and methods described herein can be embodied in various forms. Therefore, specific structural and functional details disclosed herein are not to be interpreted as limiting, but merely as a basis for the claims and as a representative basis for teaching one of ordinary skill in the art to variously employ the disclosed subject matter in virtually any appropriately detailed structure and function. Further, the terms and phrases used herein are not intended to be limiting, but rather, to provide an understandable description. Additionally, unless otherwise specifically expressed or clearly understood from the context of use, a term as used herein describes the singular or the plural of that term.

Referring to FIGS. 1 to 9, an example of a collapsible hanger 100 is shown, according to various embodiments of the present disclosure. The collapsible hanger 100 comprises a left arm 102 and a right arm 104 which are joined together by a hinge 202. The left arm 102 has a hinged end 110 and a distal end 106. The right arm 104 similarly has a hinged end 112 and a distal end 108. The hinge 202 is attached to both hinged ends 110, 112. A pin 710 in the hinge 202 holds the hinge 202 together. The pin 710, in the example, also provides indication of an axis of rotation for the arms 102, 104. A hook 107 is moveably coupled to the left arm 102.

Figure 9:
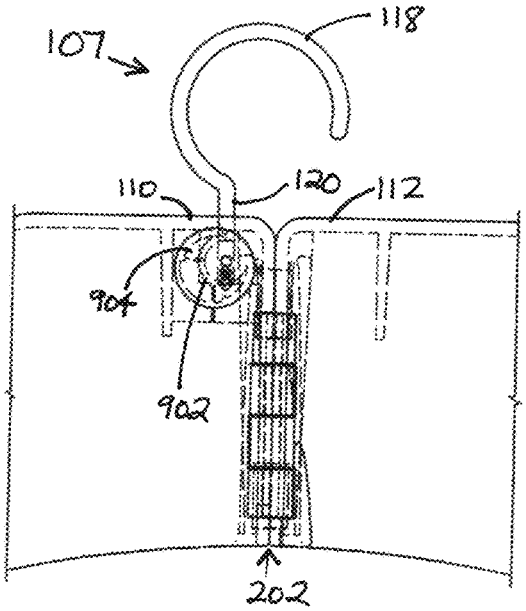
FIG. 9 is an x-ray view of the rear-side of the collapsible hanger of FIG. 1, showing the hinge and the hook and detent mechanism, according to various embodiments of the present disclosure.

A hook 107 has a curved end 118 and a straight end 120. According to the present example, a pin hole near the end of the straight end 120 provides a mechanical joint that receives a locking pin 712 that secures the hook 107 to a mechanical joint at the hinged end of the left arm 102 in a rotational coupling arrangement. The locking pin 712 mates with a mating hole 714 in the straight end 120 of the hanger hook 107, and thereby secures the hanger hook 107 to a toothed wheel 902 that rotates along with rotation of the hook 107. A plastic end cap 716 mates with the other end of the locking pin 712, and provides a decorative cover on the locking pin 712. The toothed wheel 902 rotates with its teeth being progressively rotationally engaged with notches along an outer circular structure 904 at least partially surrounding a portion of the toothed wheel 902, thereby providing a detent mechanism as shown in FIG. 9.

The straight end 120 of the hook 107, the toothed wheel 902, and the notched outer circular structure 904, are mechanically coupled together providing a detent mechanism that allows the hook 107 to gradually, progressively, rotate between at least two positions, and in certain embodiments several positions. The detent mechanism holds the hanger hook 107 in one or more of a plurality of positions around the rotatable coupling arrangement, until sufficient rotation force is applied to the hanger hook 107 to overcome the holding force of the detent at the particular position.

In the present example, the detent mechanism releases the hanger hook 107 from being held in one of a plurality of positions around the rotatable coupling arrangement by application of an external rotational force to the hanger hook 107 relative to the respective hinged end 110 of the left arm 102. For example, a user of the collapsible hanger 100 can push using rotational force on the hanger hook 107 relative to the hinged end 110 such that the hanger hook 107 is released from the current position in the detent. The hanger hook 107 may then rotate to, and be held in, a next rotational position defined by the detent mechanism.

At the first position of the hook 107, according to the present example, the curved end 118 of the hook 107 is located above a top side of the hanger arms 102, 104. The curved end 118 of the hook 107, when in the first position (e.g., in an expanded state), can be used to hang the hanger 100 from another separate supporting structure (e.g., a hanger rod) in a known manner. See, for example, FIGS. 1, 2, and 9. With the curved end 118 of the hook 107 above the top side of the left arm 102 of the hanger 100, and with the hook 107 being out of the way from the rotational path of the hinged ends 110, 112, the hanger arms 102, 104 can be rotated relative to each other between an expanded state and a collapsed state of the arms without impediment from the hook 107.

Figure 8:
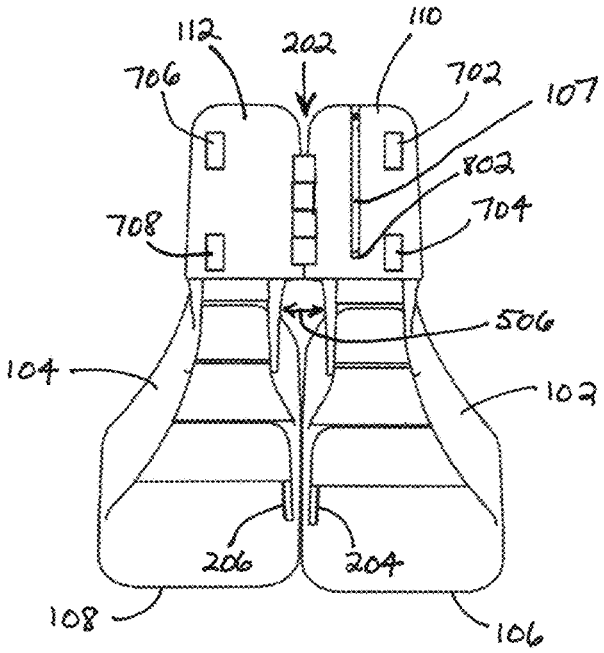
FIG. 8 is a perspective view of the collapsible hanger of FIG. 1, showing the hinged sides of the hanger's arms in a collapsed state, according to the present disclosure.

At the second position of the hook 107, according to the present example, the curved end 118 of the hook 107 is located below a top side of the hanger arms 102, 104. The curved end 118 of the hook 107, when in the second position (e.g., in a retracted state), can be rotated into a slot opening 802 and recess in the hanger 100. The curved end 118 of the hook 107 can be fully inserted into the slot opening 802 and recess in the hanger 100 as illustrated in the example of FIG. 8. In this way, the hook 107 can be retracted into the slot opening 802 and held inside the recess in the hanger 100. For example, the detent mechanism can hold the hook 107 secured in the recess in the hanger 100. Other mechanisms may be used to securely hold the hook 107 inside the recess. With the hook 107 out of the way inside the recess, the hanger arms 102, 104 can be rotated between the expanded state and the collapsed state without impediment from the hook 107. It should be understood that the hanger 100 arms 102, 104, can be in either an expanded state or a collapsed state independently of the hook 107 being in either an expanded state or a retracted state.

Figure 10:
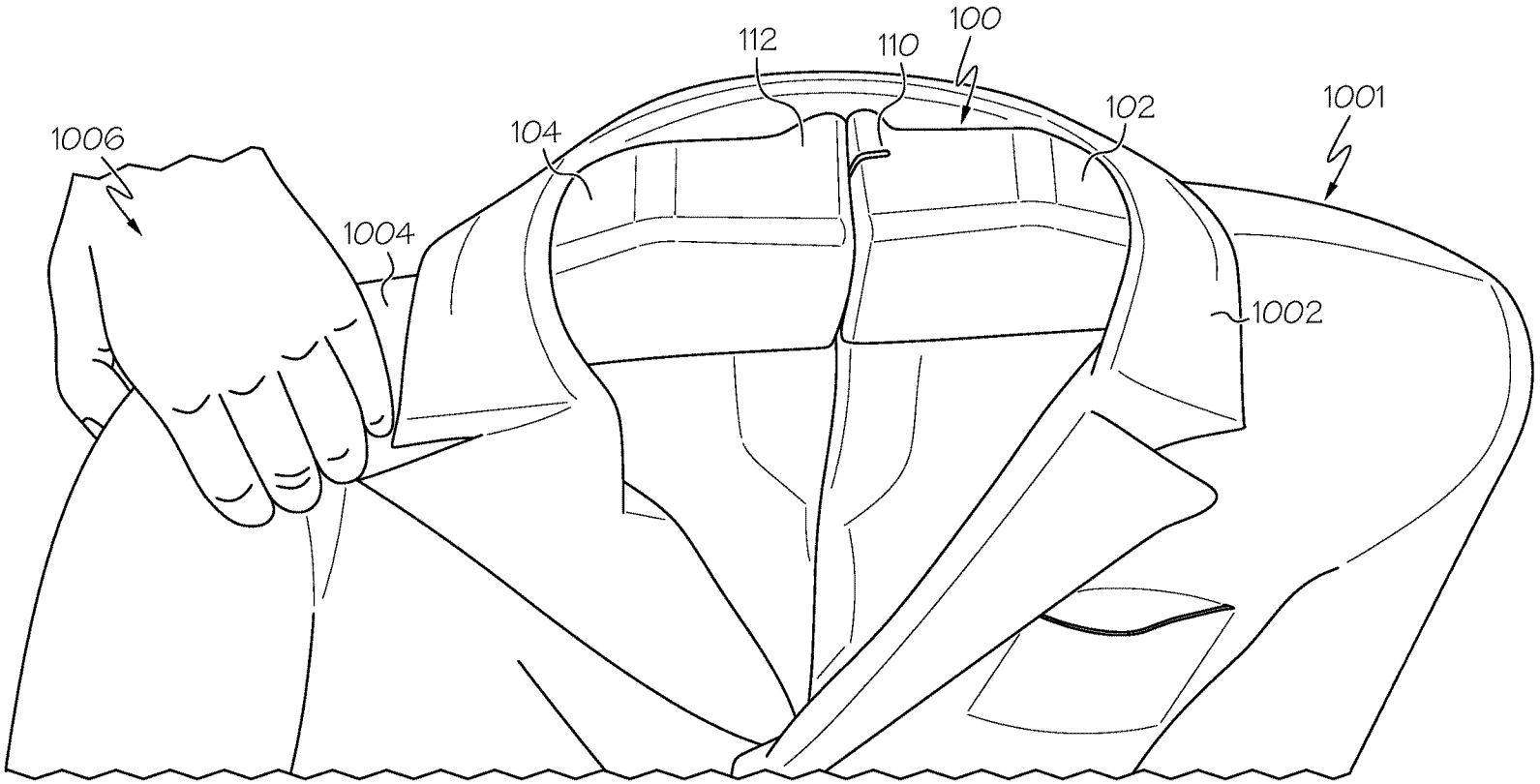
FIG. 10 is a front-side view of the collapsible hanger showing a user carrying a jacket on the hanger, with the jacket collar being held in the collapsed hanger arms, and showing the hook rotated to a position where the curved end of the hanger hook is rotated into a slot opening and recess in the respective hinged end of the hanger arm.

FIG. 10 shows an example of a user's hand 1006 carrying a jacket 1001 on the hanger 100 with the hook 107 retracted into the slot opening 802 and recess in the hanger 100 and showing the hanger arms 102, 104 in an expanded state. The hinged ends 110, 112 are held together with magnetic attractive force between the plurality of magnets 702, 704, 706, 708, which are more clearly visible in FIG. 8. The hanger's left arm 102 is inserted into the jacket 1001 supporting the left shoulder and arm 1002 of the jacket 1001. Similarly, the hanger's right arm 104 is inserted into the jacket 1001 supporting the right shoulder and arm 1004 of the jacket 1001.

Figure 2:
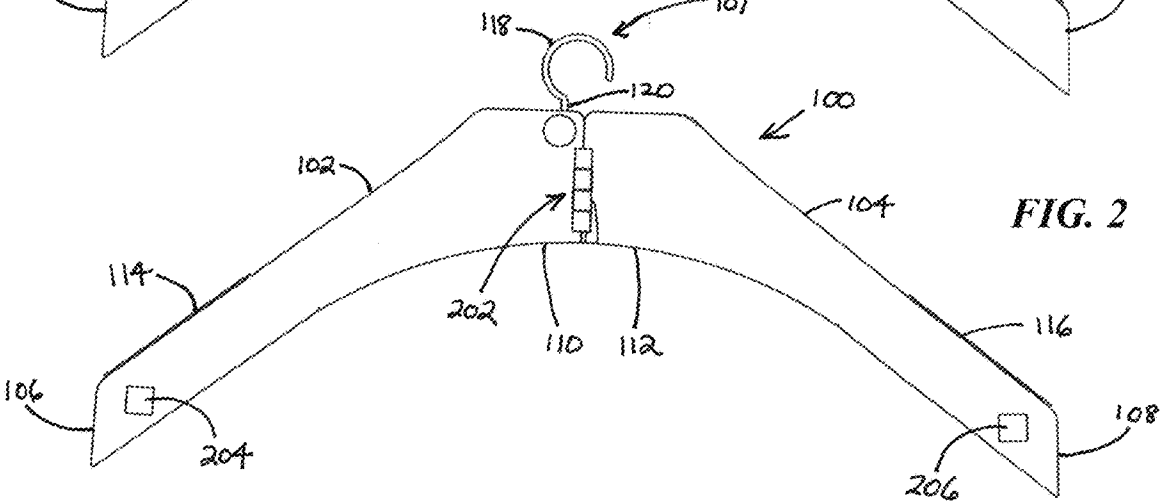
FIG. 2 is a rear-side view of the collapsible hanger of FIG. 1.
Figure 3:
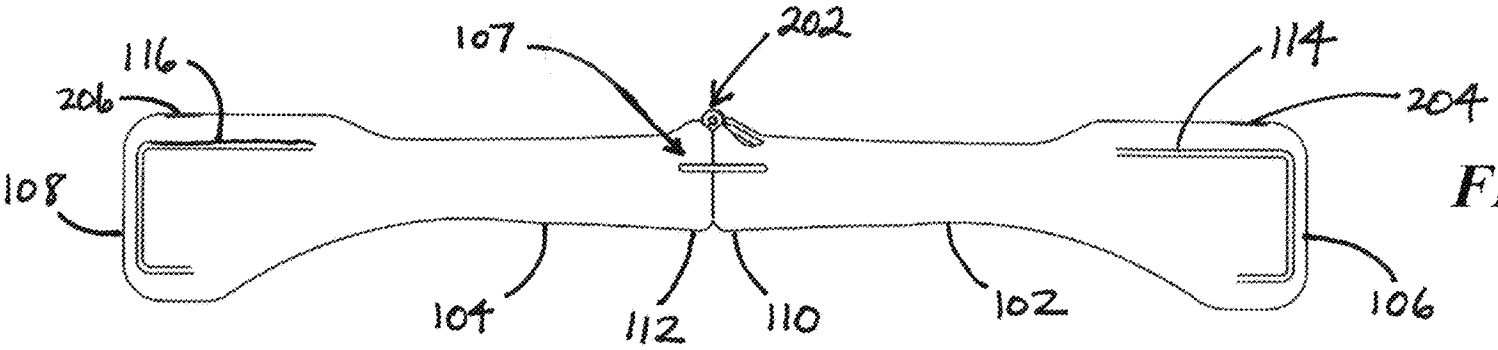
FIG. 3 is a top-side view of the collapsible hanger of FIG. 1.
Figure 5:
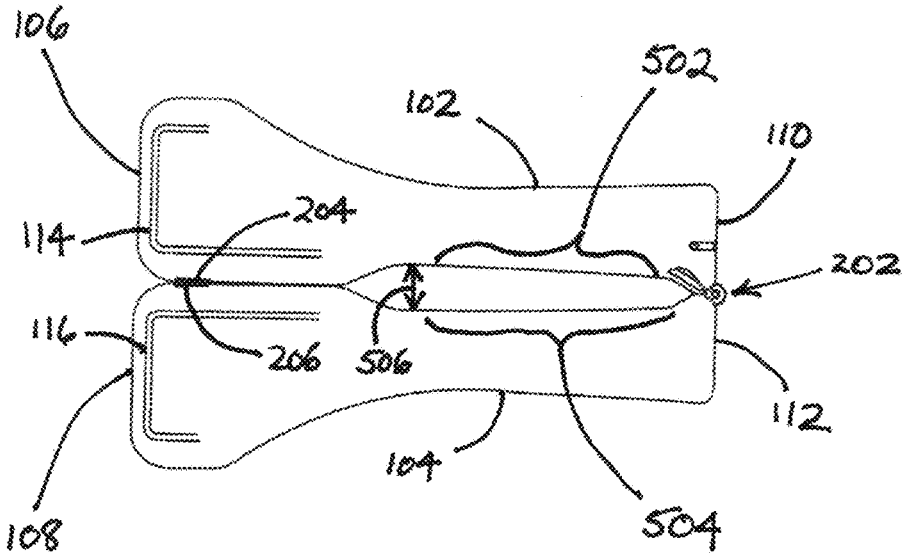
FIG. 5 is a top-side view of the collapsible hanger with the hanger arms in a collapsed state, according to various embodiments of the present disclosure.
Figure 6:
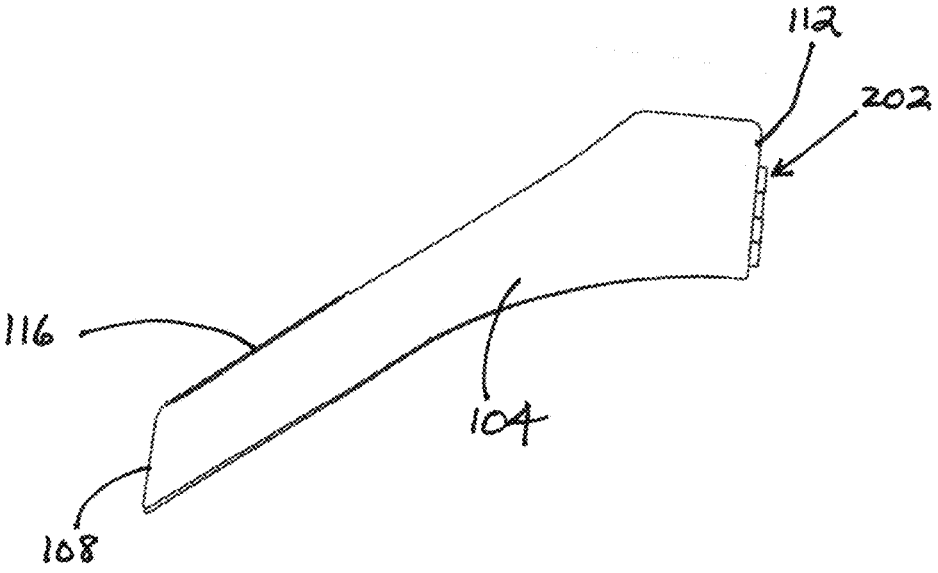
FIG. 6 is a left-side view of the collapsible hanger of FIG. 5, according to the present disclosure.
Figure 7:
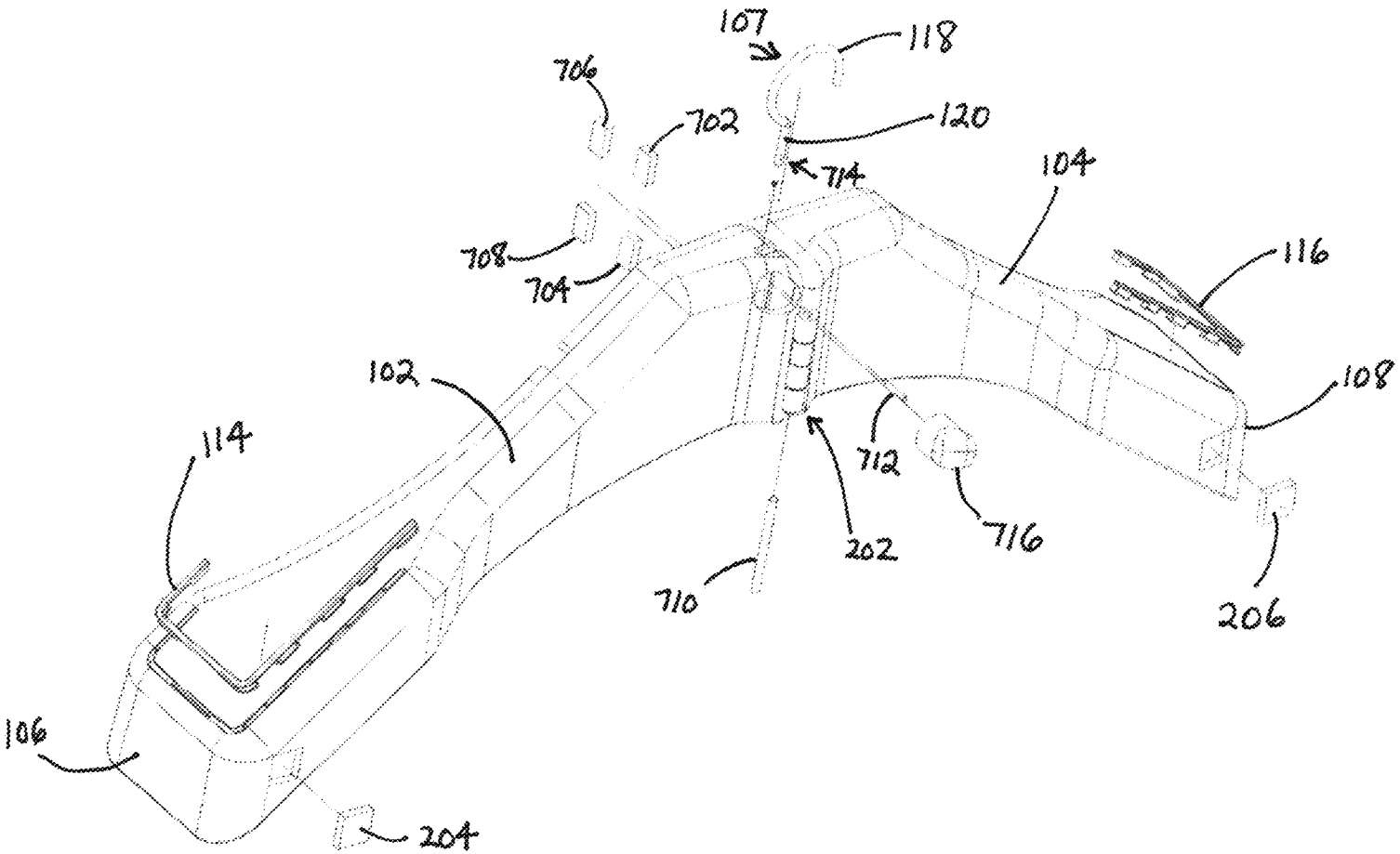
FIG. 7 is an exploded view of the collapsible hanger of FIG. 1 showing various example component parts, according to various embodiments of the present disclosure.

With particular reference to FIGS. 3, 5, and 7, the top side of the left arm 102 near its distal end 106, according to the present example, includes a raised rubber strip 114 that generally follows the outer perimeter of the distal end 106. Similarly, the top side of the right hanger arm 104 near its distal end 108 includes a raised rubber strip 116 that generally follows the outer perimeter of the distal end 108. Each of the raised rubber strips 114, 116 has a set of tabs that mate into small slots in the top side of each of the left and right arms 102, 104. The raised rubber strips 114, 116 help prevent the material of the shoulders of a garment being held by the hanger 100 from migrating or slipping off the hanger arms 102, 104. The raised rubber strips 114, 116 help prevent the garment material from migrating or slipping from the hanger 100 in the various states of the hanger arms 102, 104. For example, in an expanded state of the hanger arms 102, 104, such as shown in FIGS. 1 and 2, the garment material can be prevented from slipping from the distal ends 106, 108 of the hanger arms 102, 104. As another example, in a collapsed state of the hanger arms 102, 104, such as shown in FIG. 5, the garment material can be prevented from slipping from the gap 506. By preventing the garment material from slipping from the desired locations on the hanger 100, it helps maintain continued shoulder and collar support to prevent structural and/or shape collapse or degradation in those garment areas.

Figure 4:
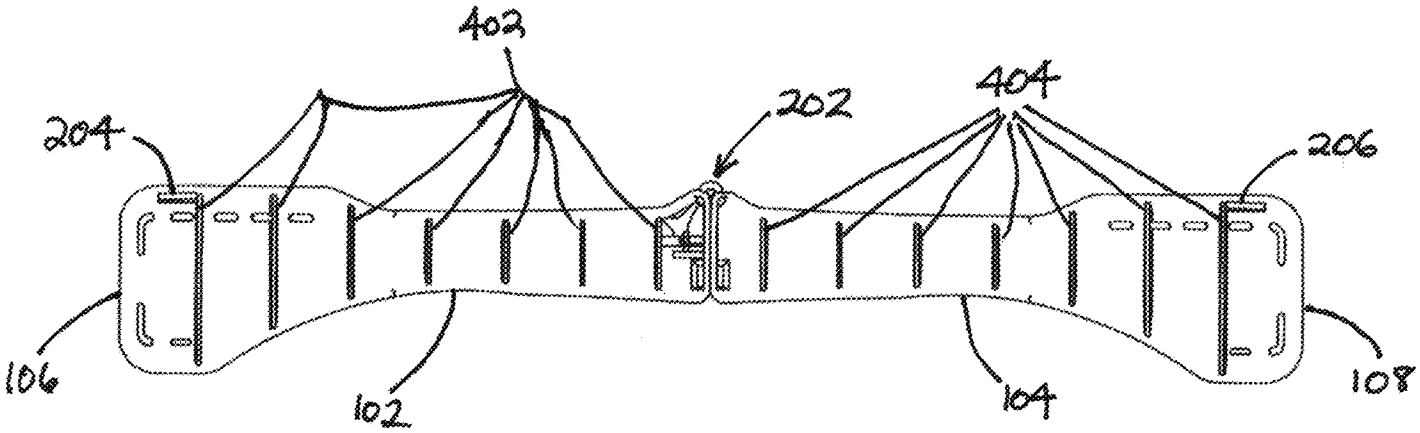
FIG. 4 is a bottom-side view of the collapsible hanger of FIG. 1.

With reference to FIG. 4, each of the left and right arms 102, 104 according to the present example, comprise a hollow recess region including a set of reinforcing bars 402, 404 inside the hollow recess region of each respective arm 102, 104. The reinforcing bars 402, 404 provide mechanical strength and at least some rigidity to the arms 102, 104 to help support garments on the hanger 100 with the hanger arms, in the expanded state, inserted into the sleeves of the garment. These reinforcing bars 402, 404 are only visible in the bottom-side view of the collapsible hanger 100 shown in FIG. 4. Under normal use, the hanger 100 appears as a solid and sturdy high quality hanger 100, without readily showing the reinforcing bars 402, 404. It should be noted that while a number of the reinforcing bars 402, 404, are used in this example, other examples of the hanger 100 can be implemented with very few or with no reinforcing bars 402, 404

In the current example, the hanger arms 102, 104 are made of a high strength plastic or polymer material, for example polycarbonate. Texturing and coloring on the outer surfaces of the hanger arms 102, 104 can make the hanger 100 appear to be made of different types of materials. For example, the hanger arms 102, 104 can be textured and colored such as to appear to be made from wood, carbon fiber, aluminum, etc. Further, the hanger hook 107 could be made of a strong metal and could be colored such as to appear a precious metal or another high value metal, e.g., gold, silver, platinum, copper, brass, and the like. These added aesthetic features convey an appearance of high quality for the hanger 100, while the strong plastic construction reduces the hanger's weight and construction and assembly cost. This enhances the commercial viability of the hanger 100 in the marketplace.

Referring to FIGS. 2, 5, 7, and 8, it can be seen that the rear side of the left arm 102 near its distal end 106 includes at least one magnet 204. While one magnet 204 is shown, a plurality of magnets can be located at the distal end 106. Similarly, the rear side of the right arm 104 near its distal end 108 includes at least one magnet 206. While one magnet 206 is shown, a plurality of magnets can be located at the distal end 108. The magnets 204, 206, can be colored or tinted to provide a higher quality finish to the hanger 100. The plurality of magnets 204, 206 at the distal ends 106, 108, when in proximity to each other magnetically attract each other. The magnetic attractive force between the plurality of magnets 204, 206, when in proximity to each other, holds secure the left arm 102 to the right arm 104 while the hanger 100 is in a collapsed state. This arrangement of the collapsible hanger 100 is shown in FIG. 5. The use of the plurality of magnets 204, 206, helps hold secure the left arm 102 to the right arm 104 while preventing harmful and damaging indents and/or penetration of garments while the hanger arms 102, 104 are in the collapsed state.

The present example shows the hinge 202 being mechanically coupled with the hinged ends 110, 112 of the left and right arms 102, 104, proximal to a rear side of the first and second arms. However, it is understood that, according to alternative embodiments, the hinge 202 could be mechanically coupled with the hinged ends 110, 112 of the left and right arms 102, 104, proximal to the front side of the first and second arms 102, 104. In this alternative, the arms 102, 104 would rotate toward the front side to be rotated from an expanded state to a collapsed state.

The collapsible hanger 100 can be in an expanded state, i.e., with both arms 102, 104 extended opposite each other in an expanded state and ready to be inserted into the sleeves of a hanging garment to support the hanging garment. This expanded state is shown, for example, in FIGS. 1 and 2. The arms 102, 104, are held together in the expanded state by the hinge 202 and by a plurality of magnets 702, 704, 706, 708, located in the hinged ends 110, 112 of the arms 102, 104. In this example, as shown in FIG. 8, the hinge 202 is mechanically coupled with the hinged ends 110, 112 proximal the rear side of the arms 102, 104, and there are at least two magnets 702, 704 located in the hinged end 110 of the left arm 102 proximal the front side of the arm 102, and at least two magnets 706, 708 located in the hinged end 112 of the right arm 104 proximal the front side of the arm 104. The arms 102, 104 would rotate toward the rear side to be rotated from an expanded state to a collapsed state. While four magnets are shown in the current example, various embodiments of the present disclosure may include two or more magnets paired together with at least one magnet located at each of the hinged ends 110, 112. In the example, the two magnets 702, 706 near the top side of the arms 102, 104 are paired together and magnetically attractive with each other. Likewise, the two magnets 704, 708 near the bottom side of the arms 102, 104 are paired together and magnetically attractive with each other. When the arms 102, 104 are extended opposite each other from the hinged ends 110, 112 to the distal ends 106, 108, the hinge 202 and the plurality of magnets 702, 704, 706, 708 securely hold the hinged ends 110, 112 together. The magnets 702, 704, 706, 708, can be colored or tinted to provide a higher quality finish to the hanger 100.

It should be noted that in an alternative embodiment the hinge 202 could be coupled with the hinged ends 110, 112, proximal to the front side of the arms 102, 104. In this alternative, at least one magnet would be located at each of the hinged ends 110, 112, proximal to the rear side of the arms 102, 104. The arms 102, 104 would rotate toward the front side from an extended state to a collapsed state.

The collapsible hanger 100 can be in a collapsed state, i.e., with both arms 102, 104 rotated from the expanded state to the collapsed state using the hinge 202. In the collapsed state, the lengths of the arms 102, 104 (i.e., extending from the hinged ends 110, 112 to the distal ends 106, 108) are generally adjacent to each other as illustrated in FIG. 5. The two magnets 204, 206 are paired together in proximity to each other in the collapsed state. The collapsed arms 102, 104 are secured together by the attractive magnetic force between the plurality of magnets 204, 206 near the distal ends 106, 108 of the arms 102, 104. The attractive magnetic force between the magnets 204, 206 in proximity with each other in the collapsed state is strong enough to hold together the distal ends 106, 108 of the arms 102, 104 through garment material from a garment such as a shirt or a suit located between the magnets 204, 206 and being held by the arms 102, 104.

Figure 11:
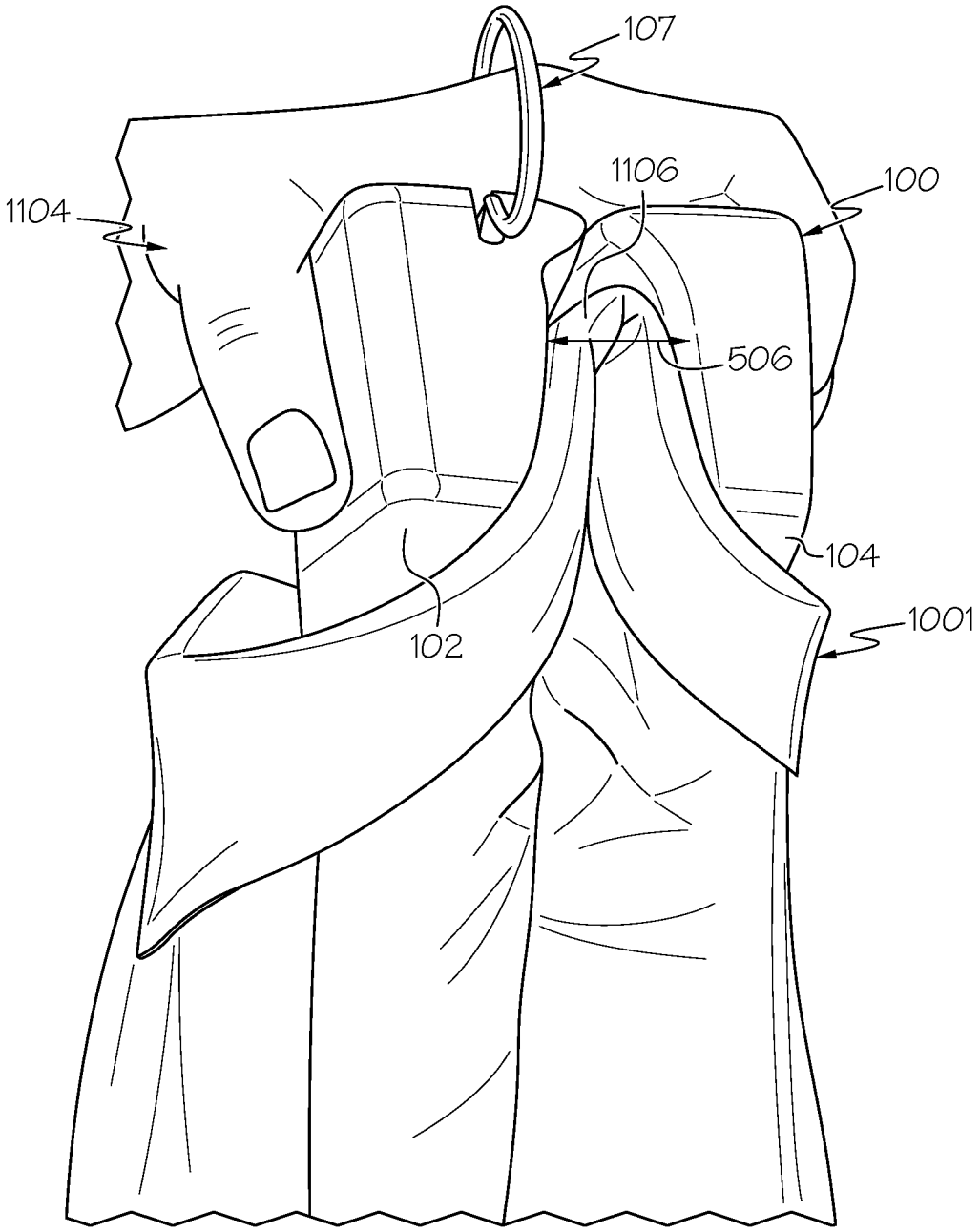
FIG. 11 is a top-side view of the collapsible hanger with the arms in a collapsed state holding a folded jacket, with the jacket collar being held in the collapsed hanger arms, and showing the hook rotated to a position where the curved end of the hanger hook is rotated to a fully expanded state, according to various embodiments of the present disclosure.
Figure 12:
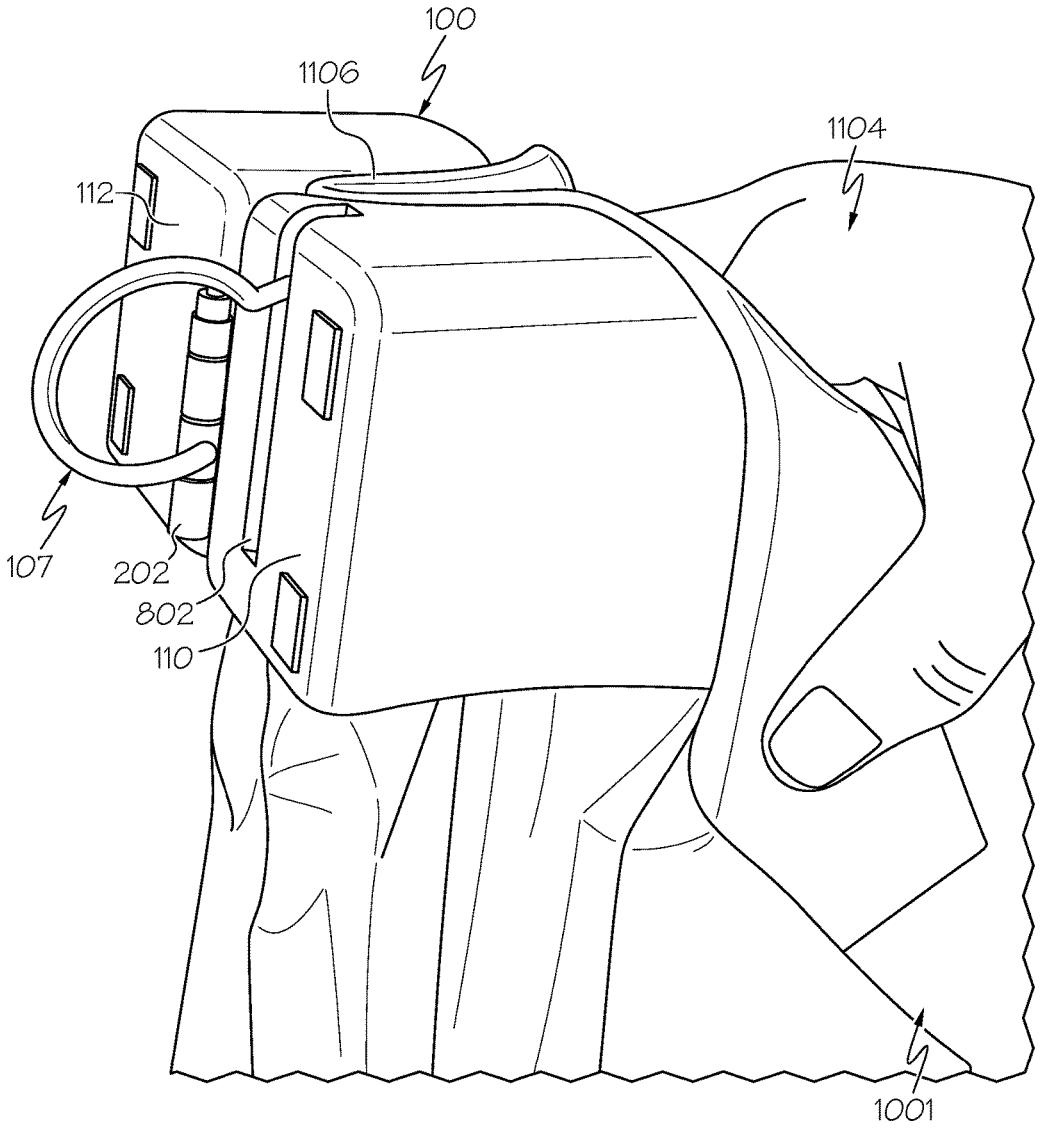
FIG. 12 is a view of the collapsible hanger in FIG. 11 showing the hook rotated to a position where the curved end of the hanger hook is located below a top side of the respective hinged end of the hanger arm, and showing the jacket collar being held in the collapsed hanger.

An example of this arrangement of the collapsible hanger 100 is shown in FIGS. 11 and 12. A jacket 1001 is held by the sleeve arms 102, 104 when the collapsible hanger 100, while inserted into the sleeve arms of the jacket 1001, is rotated by a user 1104 from the expanded state to the collapsed state of the hanger 100. The jacket 1001 is folded toward its rear side while mounted on the hanger 100 and held in this position by the hanger arms 102, 104 in the collapsed state. The magnets 204, 206, in proximity to each other while the hanger 100 is in the collapsed state, attract each other with magnetic force passing through the material of the jacket 1001. The collapsed arms 102, 104 are secured together, and hold the jacket 1001 in a folded state near its shoulder region, by the attractive magnetic force between the magnets 204, 206 near the distal ends 106, 108 of the arms 102, 104.

Figure 13:
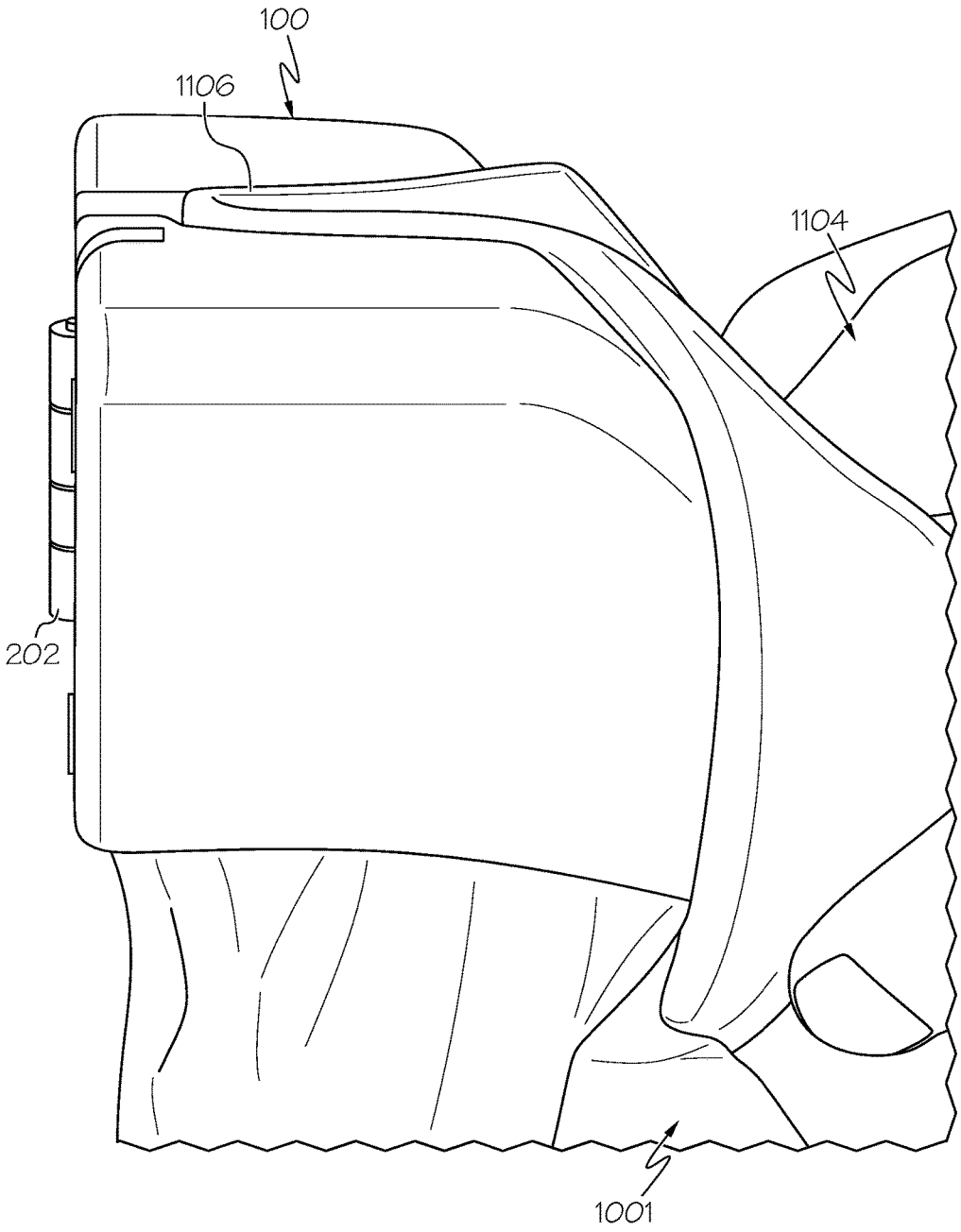
FIG. 13 is a view of the collapsible hanger in FIG. 11 showing the hook rotated to a position where the curved end of the hanger hook is rotated into a slot opening and recess in the respective hinged end of the hanger arm, and showing the jacket collar being held in the collapsed hanger arms.

As shown in FIGS. 11, 12, and 13, while the hanger 100 arms 102, 104, are in a collapsed state, the fold 1106 at the collar region of the jacket 1001 is maintained generally loose, wrinkle-fee, and crease-free. FIG. 11 shows the hanger hook 107 rotated to a position where the curved end 118 of the hanger hook 107 is rotated to a fully expanded state. FIG. 12 shows the hanger hook 107 rotated to a position where the curved end 118 of the hanger hook 107 is located below a top side of the respective hinged end of the hanger arm. FIG. 13 shows the hanger hook 107 rotated to a position where the curved end 118 of the hanger hook 107 is rotated into a slot opening and recess in the respective hinged end of the hanger arm.

The gap 506 formed by the collapsed arms 102, 104 while in the collapsed state, as also shown in FIGS. 5 and 8, helps keep the fold 1106 loose, wrinkle-fee, and crease-free, thereby preventing wrinkling and crushing of the garment collar. The gap 506 is formed by inwardly curved surface areas 502, 504 at the rear side of the respective arms 102, 104. The inwardly curved surface areas 502, 504, according to the present example, start at a region proximal to the hinged ends 110, 112 extend toward the distal ends 106, 108 and stop at a region generally in a middle portion of the arms 102, 104. The gap 506 maintaining separation between the inwardly curved surface areas 502, 504 of the collapsed arms 102, 104 helps the fold 1106 of the garment, especially around the collar region of the garment, to remain loose, wrinkle-fee, and crease-free while the garment is held by the collapsed hanger arms 102, 104. According to the present example, the gap formed provides at least approximately half an inch of separation between the inwardly curved surface areas of the arms. The folded garment, with the hanger arms in the collapsed state, can be conveniently stored in at least one of a brief case, suit case, personal carrying bag, storage container, and drawer. Various alternative embodiments can form a gap between the inwardly curved surface areas of the arms to provide different separation distances, which may be greater than or less than the half an inch of separation according to the present example.

Alternative Example of the Collapsible Hanger

Figure 14:
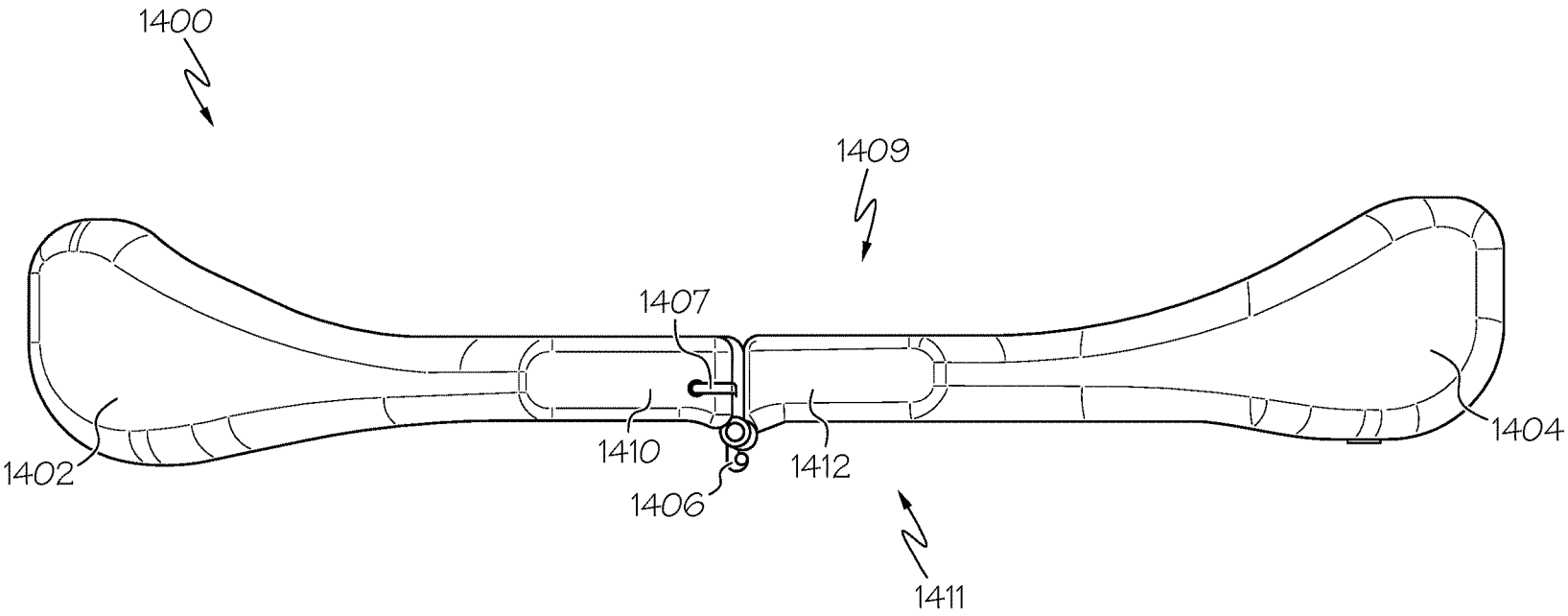
FIG. 14 is a top-side view of an alternative example collapsible hanger, according to various embodiments of the present disclosure.

FIGS. 14 to 18 illustrate an alternative example of the collapsible hanger 100, 1400, according to various embodiments of the present disclosure. FIG. 14 shows a top view of the alternative example collapsible hanger 1400. It generally corresponds to the collapsible hanger 100 that was discussed above. Arrow 1409 indicates the front side of the collapsible hanger 1400. Arrow 1411 indicates the rear side of the collapsible hanger 1400. The left hanger arm 1402 is rotatably coupled at its hinged end 1410 with the hinged end 1412 of the right hanger arm 1404.

Figure 15:
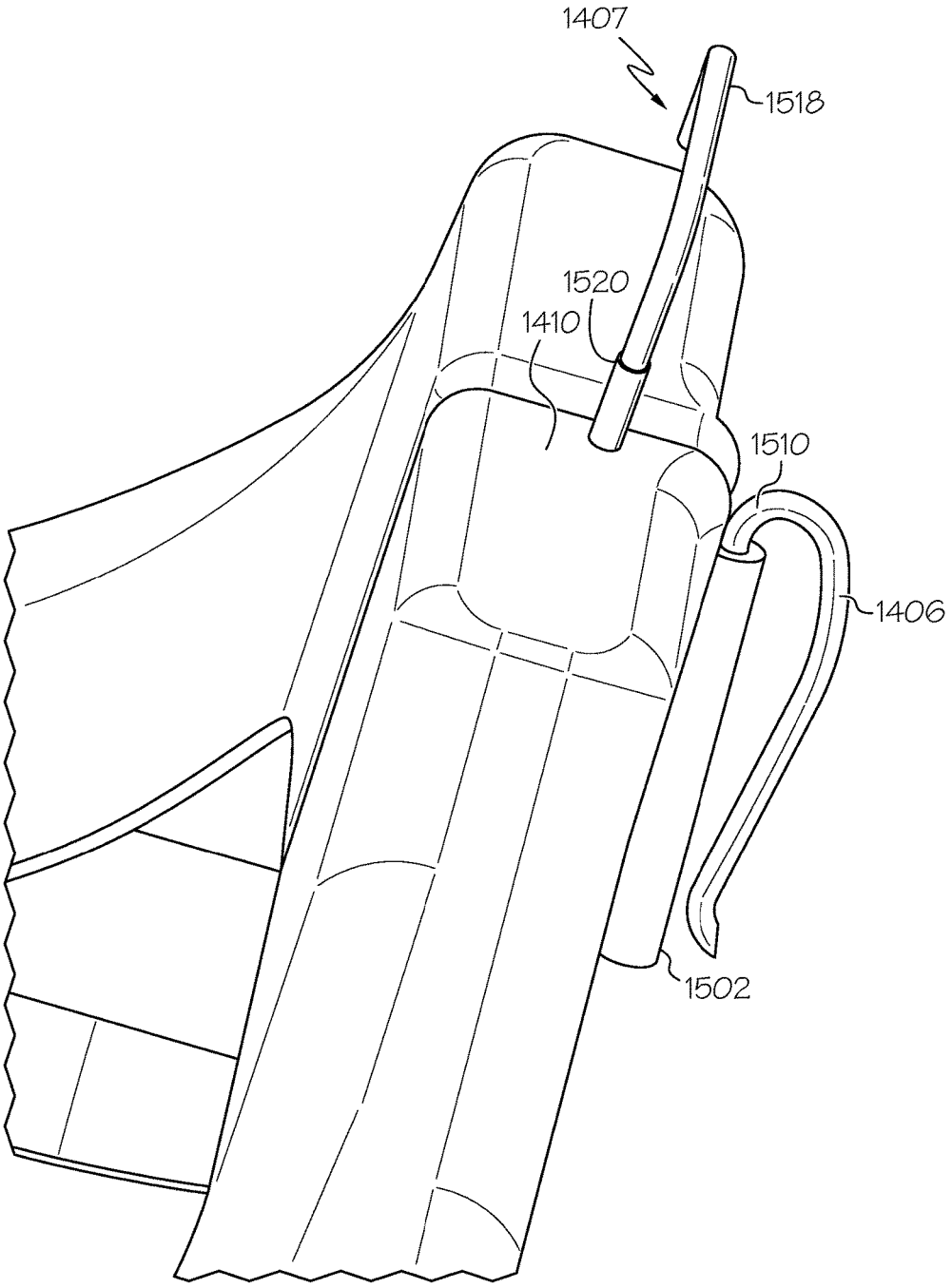
FIG. 15 is a top left perspective view of the alternative example collapsible hanger of FIG. 14.

In this alternative example, the pin 710 in the hinge 202 of the collapsible hanger 100 (see FIGS. 7 and 8) has been replaced with a pin 1510 that is mechanically coupled with a clasp 1406 at the hinge 1502 (see FIGS. 14 and 15). The clasp 1406, according to certain embodiments, can comprise a curved portion of the pin 1510 overhanging, in close proximity to, the outer surface of the hinge 1502 to form the clasp therewith. In other example embodiments, the clasp (not shown) could be formed as a clasp structure separate from, but in close proximity to, the hinge 1502. The clasp 1406 can additionally securely hold the collar of the garment to the hinged ends of the hanger arms 1402, 1404. The separate clasp structure, according to this other example embodiment, could operate as a clasp separate from the outer surfaces of the hinge 1502 to securely hold the collar of the garment to the hinged ends 1410, 1412, of the hanger arms 1402, 1404, of the collapsible hanger 1400. While the clasp is discussed in the example above as holding the collar of the garment, it should be understood that the clasp can be used to hold other portion of the garment. The purpose of the clasp is to immobilize the garment relative to the hanger hinged ends 1410, 1412, of the hanger arms 1402, 1404, of the collapsible hanger 1400. In this way, the possibility of wrinkling this region of the garment while collapsing the hanger 1400 is significantly reduced or entirely eliminated.

The clasp 1406, according to the present example, is mechanically coupled with the hinge pin 1510 such that it can function both as a hinge pin 1510 (interoperating with the inside surfaces of the rotating hinge 1502 to hold the hinge together) and as well as a clasp 1406 (interoperating with the outside surfaces of the hinge 1502) that is particularly relevant to the collapsible hanger 100, 1400, as it closes. When the collapsible hanger 100, 1400, collapses, the left hanger arm 1402 and the right hanger arm 1404 rotate toward each other at their hinged ends 1410, 1412, to close (or collapse) the hanger arms 1402, 1404, together. In this collapsing movement of the hanger arms 1402, 1404, there can be a tendency for the portion of a garment that is sandwiched between the two collapsing hanger arms 1402, 1404, (i.e., that are moving in a rotating motion toward each other) to migrate downwards causing misalignment of the shoulders of the garment and potential wrinkling thereof. This clasp feature 1406 effectively secures the collar of the garment to the hanger 1400 and prevents fabric migration. This reduces, or can entirely prevent, possible misalignment of shoulder structure support and wrinkling of the garment due to this collapsing movement of the hanger arms 1402, 1404.

In this alternative example collapsible hanger 1400, the straight end 1520 of the hanger hook 1407 is mechanically coupled with one of a ball or a socket, and the left hanger arm 1402 being mechanically coupled with the other one of the ball or socket in a ball and socket arrangement at the hinged end 1410 of the left hanger arm 1402. This allows the collapsible hanger 1400 while in the expanded state to hang from the curved end 1518 of the hanger 1407 mounted on another separate supporting structure (e.g., a hanger rod) in a known manner. Additionally, the expanded collapsible hanger 1400 using the ball and socket mechanism can have its hanger arms 1402, 1404, horizontally rotated by up to three hundred and sixty degrees (360 degrees) or more of rotation about a vertical axis running through the straight end 1520 of the hanger hook 1407.

Figure 19:
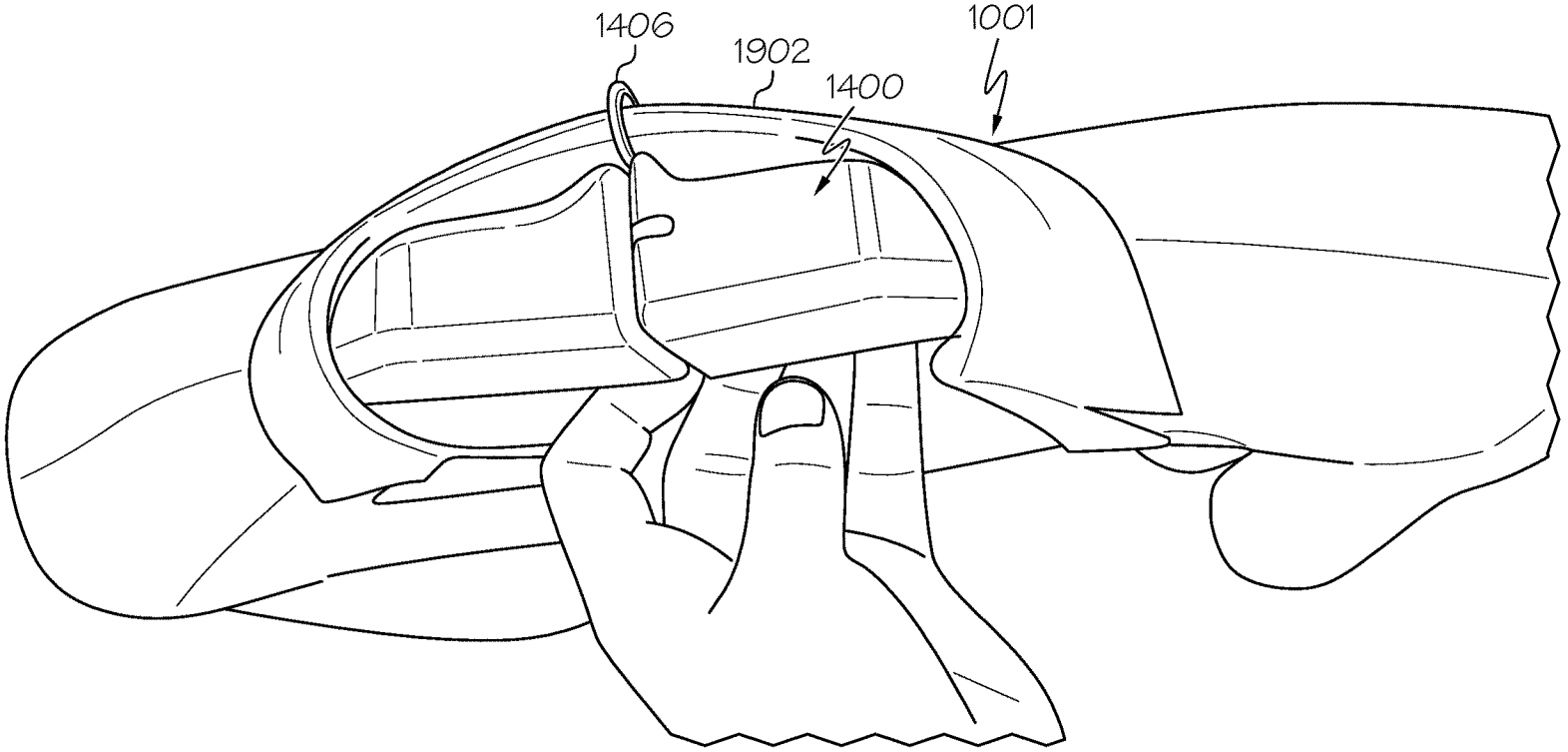
FIG. 19 is a top-side perspective view of alternative example collapsible hanger of FIG. 14 showing a user carrying a jacket on the hanger, and showing the hook rotated to a position where the curved end of the hanger hook is rotated into a slot opening and recess in the respective hinged end of the hanger arm.
Figure 20:
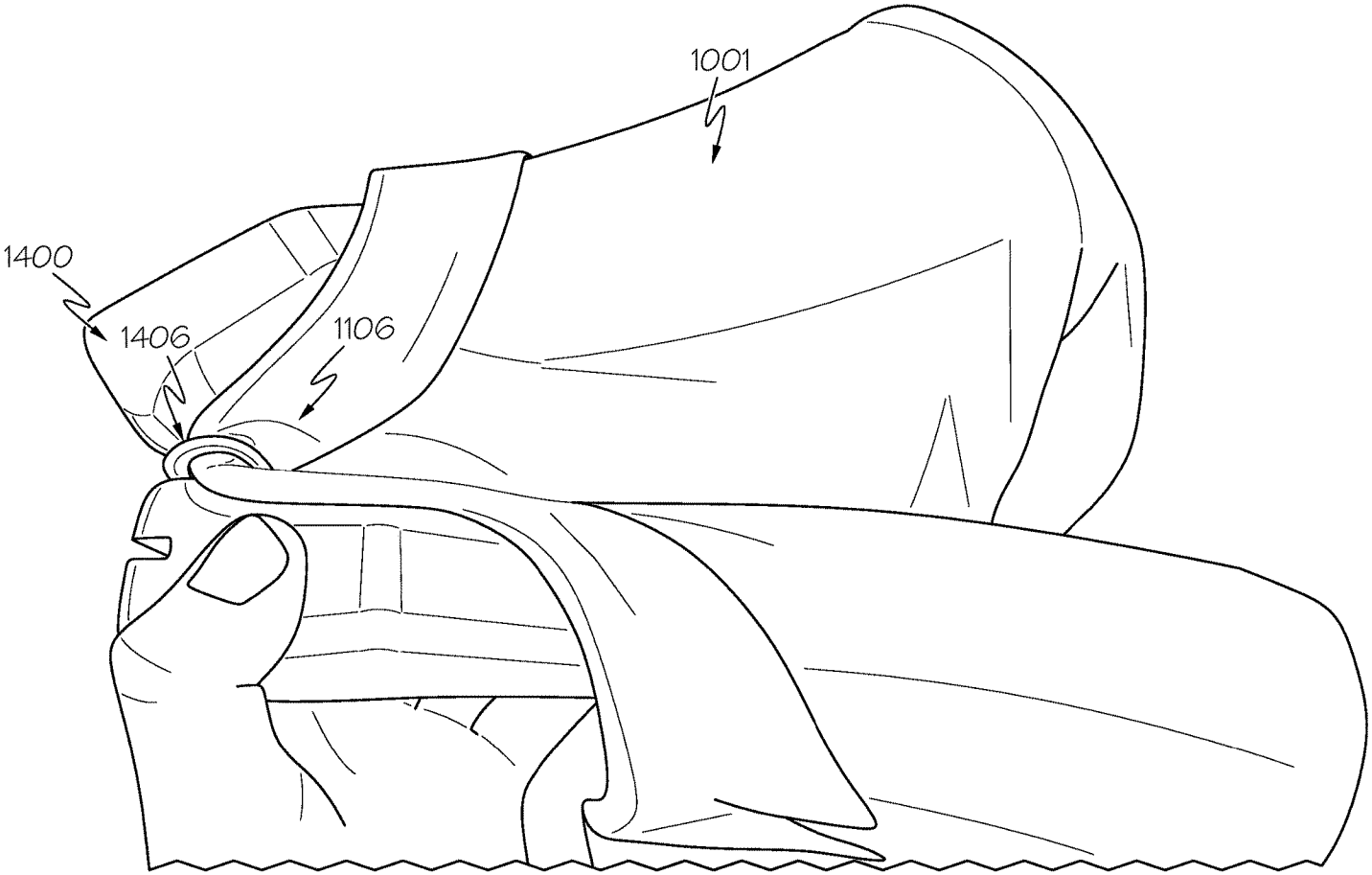
FIGS. 20 to 21 are two generally top-side perspective views of the alternative example collapsible hanger of FIG. 14 showing the hanger arms in progressively collapsed states holding the folded jacket shown in FIG. 19, with the jacket collar being held in the collapsed hanger arms by an example hanger clasp feature.
Figure 21:
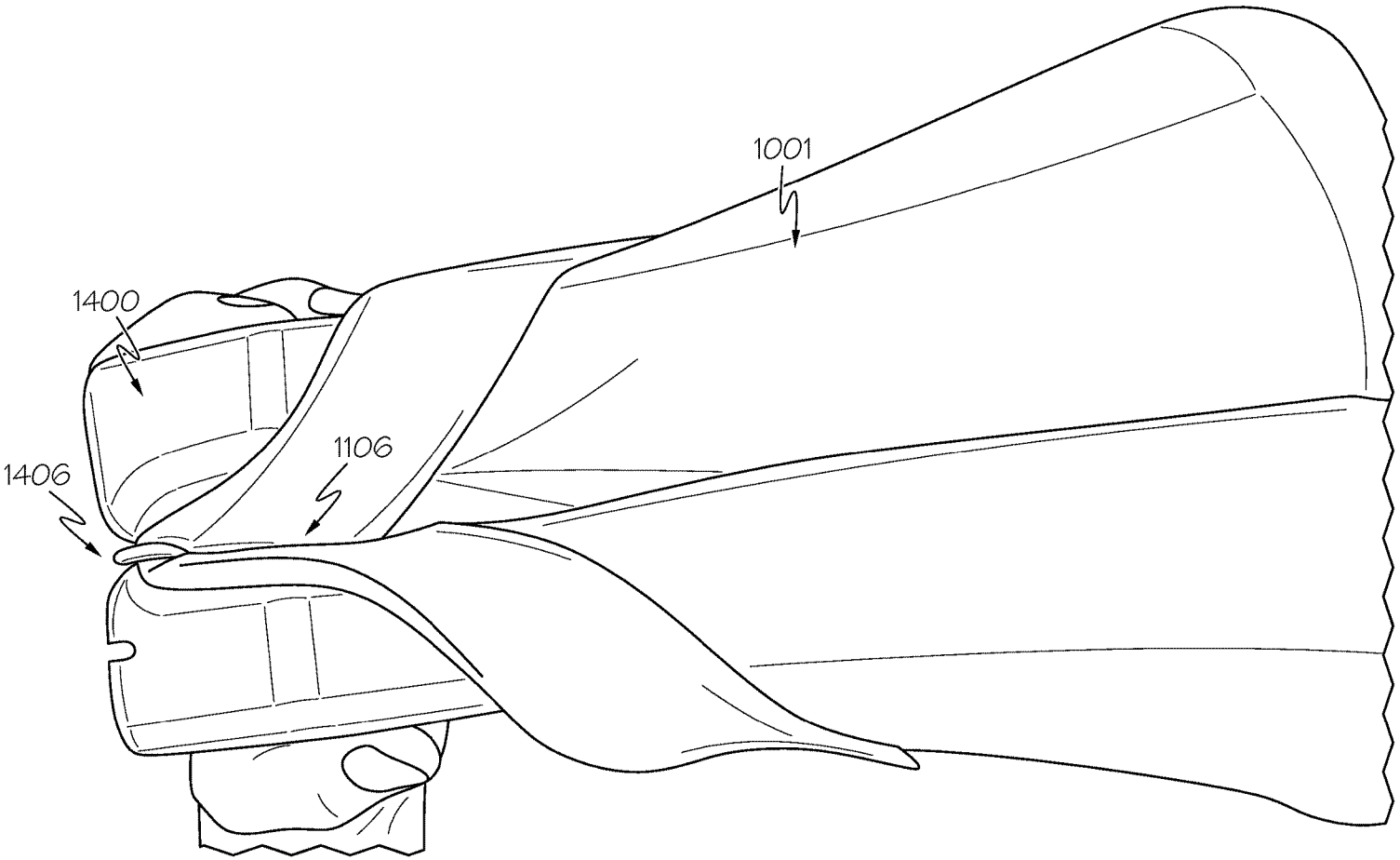

As shown in FIGS. 19, 20, and 21, according to the present example, a collar portion 1902 of a garment (e.g., a jacket) 1001 is held by a clasp feature 1406 on the hanger 1400. While the hanger 1400 is progressively collapsed (as illustrated in FIGS. 20 and 21) the clasp 1406 securely holds a fold 1106 on the collar portion 1902 of the garment 1001. This clasp feature 1406 effectively secures the collar 1902 of the garment 1001 to the hanger 1400 and prevents migration of the collar portion 1902 of the garment 1001 that is sandwiched between the two collapsing hanger arms 1402, 1404, (i.e., that are moving in a rotating motion toward each other) avoiding misalignment of the shoulders of the garment and potential wrinkling thereof. In this way, the possibility of wrinkling this region 1902 of the garment 1001 while collapsing the hanger 1400 is significantly reduced or entirely eliminated.

Figure 16:
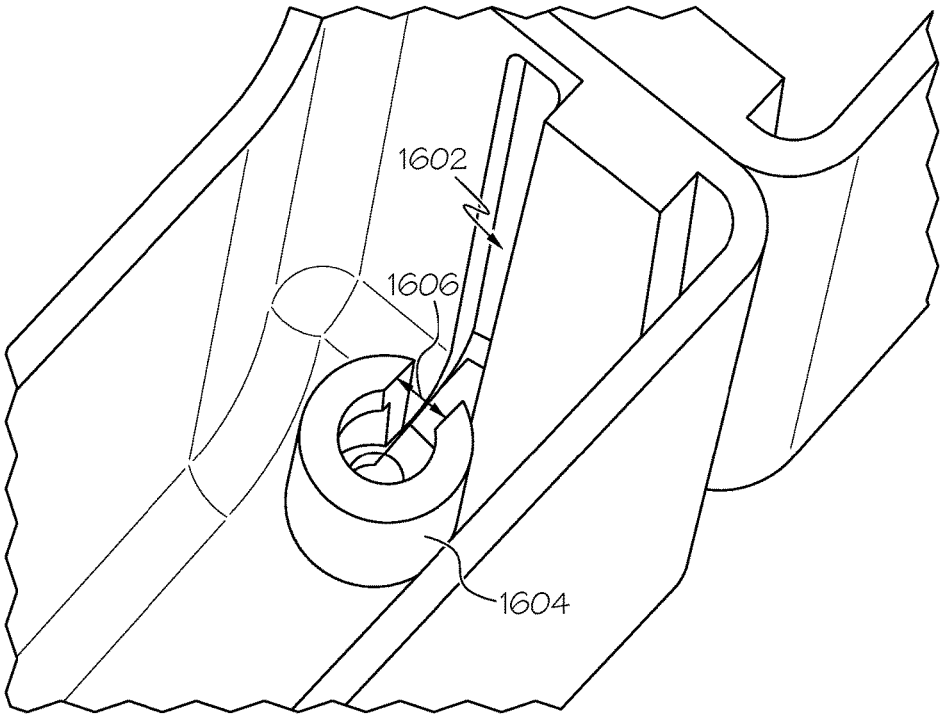
FIG. 16 is a bottom view of the hinged ends of the hanger arms of the alternative example collapsible hanger of FIG. 14.
Figure 17:
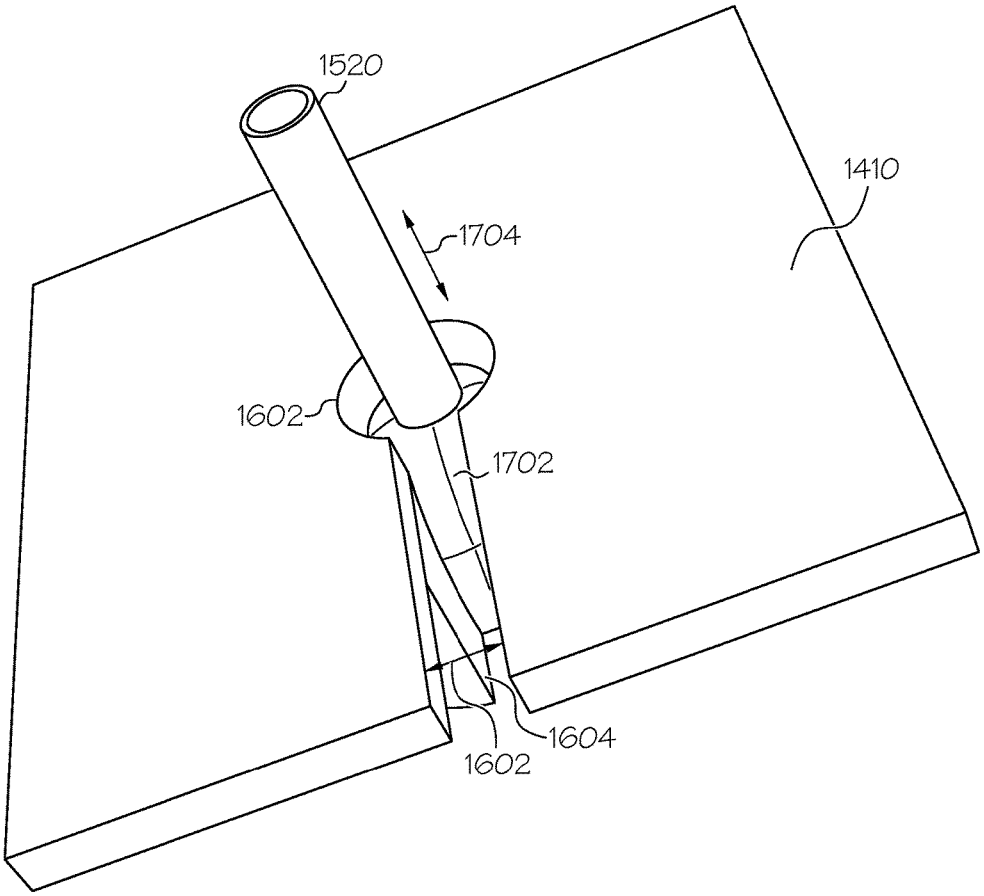
FIGS. 17 and 18 are a cut away views of a portion of the hinged end of the left hanger arm of the alternative example collapsible hanger of FIG. 14.
Figure 18:
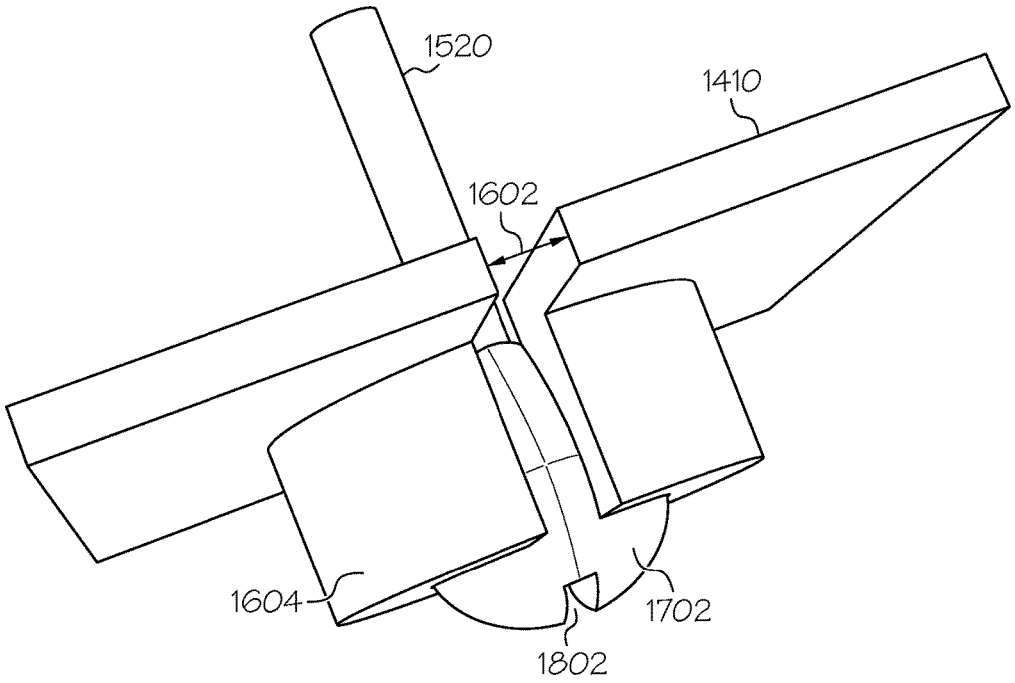

As shown in FIGS. 16, 17, and 18, according to the present example, a socket 1604 is formed on the underside of the hinged end 1410 of the left hanger arm 1402 in a recess region near the slot opening 1602 of the hinged end 1410. The socket 1604 includes a slotted region 1606 that is generally aligned with the slot opening 1602 of the hinged end 1410 of the left hanger arm 1402. The straight end 1520 of the hanger hook 1407 is mechanically coupled with the ball 1702. According to the present example, the ball 1702 is affixed to the very end of the straight end 1520 of the hanger hook 1407. The diameter of the ball 1702 is sized slightly larger than the diameter of an inside recess region of the socket 1604 that receives the ball 1702. This creates friction tension between the surface of the ball 1702 and the surface of the inside recess region of the socket 1604. The ball 1702, according to this example, does not freely move in the socket 1604. The ball 702 can be moved by external force (e.g., provided by a user on the collapsible hanger) overcoming the shear friction of these surfaces caused by the tension in the socket 1604. In this way, by overcoming the shear friction force of the ball and socket arrangement, the user can force relative movement between the hook 1407 and the rest of the hanger 1400.

This ball 1702 and socket 1604 system is used to retain the retracting hook 1407 mechanism. The hook 1407 and ball 1702 portion is installed in the socket 1604 through the bottom aperture of the hanger 1400 and pops securely in place after molding. The hook 1407 can then be rotated from the underside of the hinged end 1410 of the left hanger arm 1402, through the slot opening 1602 of the hinged end 1410, and upward into an expanded hanger hook 1407 position such as shown in FIGS. 14 and 15. The socket 1604 includes a slotted region 1606 that is generally aligned with the slot opening 1602 of the hinged end 1410 of the left hanger arm 1402.

The ball 1702, according to certain embodiments, can include a slot feature 1802 as shown in FIG. 18. This allows an external instrument (e.g., a fat head screw driver) to be used to move the ball 1702 in the socket 1604. This slot feature 1802 can be useful to adjust the position of the ball 1702 in the socket 1604.

The illustrations of examples described herein are intended to provide a general understanding of the structure of various embodiments, and they are not intended to serve as a complete description of all the elements and features of apparatus and device that might make use of the structures described herein. Many other embodiments will be apparent to those of skill in the art upon reviewing the above description. Other embodiments may be utilized and derived therefrom, such that structural and logical substitutions and changes may be made without departing from the scope of this disclosure. Figures are also merely representational and may not be drawn to scale. Certain proportions thereof may be exaggerated, while others may be minimized. Accordingly, the specification and drawings are to be regarded in an illustrative rather than a restrictive sense. Additionally, unless otherwise specifically expressed or clearly understood from the context of use, a term as used herein describes the singular or the plural of that term.

The terms "a" or "an", as used herein, are defined as one or more than one. The term "plurality", as used herein, is defined as two or more than two. The term "another", as used herein, is defined as at least a second or more. The terms "including" and "having," as used herein, are defined as comprising (i.e., open language). The term "coupled," as used herein, is defined as "connected," although not necessarily directly, and not necessarily mechanically. The term "configured to" describes structure that is adapted to, set up, arranged, commanded, altered, modified, built, composed, constructed, designed, or that has any combination of these characteristics to carry out a given function. The term "adapted to" describes structure that is capable of, able to accommodate, to make, or that is suitable to carry out a given function.

The Abstract is provided with the understanding that it is not intended be used to interpret or limit the scope or meaning of the claims. In addition, in the foregoing Detailed Description, various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

The corresponding structures, materials, acts, and equivalents of all means or step plus function elements, if any, in the claims below are intended to include any structure, material, or act for performing the function in combination with other claimed elements as specifically claimed. The description herein has been presented for purposes of illustration and description, but is not intended to be exhaustive or limited to the examples in the form disclosed. Many modifications and variations will be apparent to those of ordinary skill in the art without departing from the scope of the examples presented or claimed. The disclosed embodiments were chosen and described in order to explain the principles of the embodiments and the practical application, and to enable others of ordinary skill in the art to understand the various embodiments with various modifications as are suited to the particular use contemplated. It is intended that the appended claims below cover any and all such applications, modifications, and variations within the scope of the embodiments.

Although specific embodiments of the subject matter have been disclosed, those having ordinary skill in the art will understand that changes can be made to the specific embodiments without departing from the scope of the disclosed subject matter. The scope of the disclosure is not to be restricted, therefore, to the specific embodiments, and it is intended that the appended claims cover any and all such applications, modifications, and embodiments within the scope of the present disclosure.

What is claimed is:

1. A collapsible hanger, comprising:

a first arm and a second arm, each arm including a hinged end and a distal end, a rear side of each arm including an inwardly curved surface area starting proximal to the hinged end, extending for a length of the respective arm toward the distal end, the length being less than a full length of the respective arm;

a hinge mechanically coupled with the respective hinged ends of the first and second arms, the first and second arms being rotatable relative to each other between an expanded state, with the first and second arms extended opposite each other along an axis extending through the respective hinged ends of each arm and through the respective distal ends of each arm, and a collapsed state, with the rear side of the first and second arms being rotated adjacent to each other from the respective hinged ends of each arm to the respective distal ends of each arm;

a hanger hook comprising a curved end and a straight end, a first mechanical joint located at, or proximal to, the straight end and being rotatably coupled in a ball and socket arrangement with a second mechanical joint located at, or proximal to, the hinged end of one of the first and second arms, the first mechanical joint rotatably coupled with the second mechanical joint forming a rotatable coupling arrangement, and wherein with the first and second arms being in the collapsed state, the hanger hook being rotatable between a first position and a second position around the rotatable coupling arrangement, and where in the first position, the hanger hook curved end being located above a top side of the respective hinged end of the one of the first and second arms, and in the second position, the hanger hook curved end being entirely located below the top side of the respective hinged end of the one of the first and second arms; and the one of the first and second hanger arms including an opening and recess at the hinged end of the respective hanger arm configured to receive the curved end of the hanger hook into the opening and recess with the hanger hook rotated to the second position.

2. The collapsible hanger of claim 1, wherein the first position the hanger hook being rotatable by the ball and socket arrangement.

3. The collapsible hanger of claim 1, wherein the hanger hook being rotatable relative to the first and second hanger arms of the collapsible hanger by 360 degrees or more, the hanger hook rotatable by the ball and socket arrangement.

4. The collapsible hanger of claim 1, wherein with the collapsible hanger in the expanded state, the hanger hook being rotatable relative to the first and second hanger arms of the collapsible hanger by 360 degrees or more, the ball and socket arrangement comprising a ball in a recess of a socket with a surface of the ball in friction tension with a surface of the recess of the socket, the hanger hook rotatable relative to the first and second hanger arms by the ball and socket arrangement with external force provided overcoming shear friction between the surface of the ball in friction tension with the surface of the recess of the socket.

5. The collapsible hanger of claim 4, wherein the friction tension of the ball and socket arrangement holds the curved end of the hanger hook inside the opening and recess of the respective hinged end of the one of the first and second arms with the hanger hook rotated to the second position.

6. The collapsible hanger of claim 1, wherein the ball and socket arrangement comprises a socket located in the recess at the hinged end of the respective hanger arm.

7. The collapsible hanger of claim 6, wherein the opening at the hinged end of the respective hanger arm is a slotted opening, and wherein the socket includes a slotted region that is generally aligned with the slotted opening of the hinged end of the respective hanger arm.

8. The collapsible hanger of claim 6, wherein the ball and socket arrangement comprises a ball affixed to the straight end of the hanger hook.

9. The collapsible hanger of claim 1, wherein the hinge comprising a pin holding the hinge together, the pin being mechanically coupled with a clasp located in close proximity to the hinge, the clasp for securely holding the garment to the hinged ends of the hanger arms of the collapsible hanger.

10. The collapsible hanger of claim 9, wherein the clasp for securely holding the collar of the garment to the hinged ends of the hanger arms of the collapsible hanger.

11. The collapsible hanger of claim 9, wherein the clasp comprising a curved end portion of the pin overhanging, in close proximity to, the outer surface of the hinge.

12. The collapsible hanger of claim 9, wherein the clasp being formed as a clasp structure mechanically coupled with the pin, and being separate from, but in close proximity to, the hinge.

13. The collapsible hanger of claim 1, wherein a first at least one magnet being mechanically coupled to the hinged end of the first arm and a second at least one magnet being mechanically coupled to the hinged end of the second arm, and where in the expanded state, the first at least one magnet being in proximity to the second at least one magnet, and the first and second arms being held extended opposite each other by magnetic attractive force attracting together the first at least one magnet at the hinged end of the first arm to the second at least one magnet at the hinged end of the second arm.

14. The collapsible hanger of claim 1, wherein with the first and second arms being in the collapsed state, the hanger hook being rotatable from the first position to the second position at which the curved end of the hanger hook being rotated into the opening and recess of the respective hinged end of the one of the first and second arms.

15. The collapsible hanger of claim 1, wherein the recess comprises a recess region extending inside the respective hanger arm from the opening at the hinged end of the respective hanger arm to an externally accessible opening at a bottom side of the respective hanger arm, and wherein with the curved end of the hanger hook inside the opening and recess and the hanger hook rotated to the second position, the curved end of the hanger hook being externally accessible through the opening at the bottom side of the respective hanger arm to apply an external rotational force to the hanger hook relative to the respective hanger arm releasing the hanger hook from the second position and rotating the curved end of the hanger hook outside of the opening and recess at the hinged end of the respective hanger arm.

16. The collapsible hanger of claim 1, wherein one of a rear side and a front side of each of the first and second arms comprising an inwardly curved surface area from a region proximal to the hinged end of the each first and second arms, extending toward the distal end thereof and less than an entire length thereof, such that with the first and second arms in the collapsed state, the inwardly curved surface areas of the first and second arms being adjacent to each other forming a gap maintaining separation therebetween.

17. The collapsible hanger of claim 1, wherein the distal end of the first and second arms comprises at least one magnet, and when in proximity with each other the at least one magnet of the distal end of the first arm being magnetically attractive with the at least one magnet of the distal end of the second arm, and where in the collapsed state the first and second arms are held adjacent to each other by magnetic attractive force between the at least one magnet of the distal end of the first arm and the at least one magnet of the distal end of the second arm being in proximity with each other.

18. A collapsible hanger, comprising:

a left arm and a right arm, each arm including a hinged end and a distal end, a rear side of each arm including an inwardly curved surface area starting proximal to the hinged end and extending for a length of the respective arm toward the distal end but less than an entire length of the respective arm;

a hinge mechanically coupled with the respective hinged ends of the left and right arms, the hinge comprising a pin holding the hinge together, the pin being mechanically coupled with a clasp located in close proximity to the hinge, the clasp being configured for securely holding the garment to the hinged ends of the hanger arms of the collapsible hanger, the left and right arms being rotatable relative to each other between an expanded state, with the left and right arms extended opposite each other along an axis passing through the respective hinged ends of each arm and through the respective distal ends of each arm, and a collapsed state, with the rear side of the left and right arms being adjacent to each other from the respective hinged ends of each arm to the respective distal ends of each arm;

a hanger hook comprising a curved end and a straight end, a ball of a ball and socket arrangement being affixed to the very end of the straight end and being rotatably coupled with a socket of the ball and socket arrangement located at, or proximal to, the hinged end of the left arm, the ball rotatably coupled with the socket forming a rotatable coupling arrangement, and wherein with the left and right arms being in the collapsed state, the hanger hook being rotatable between a first position and a second position around the ball and socket arrangement, and where in the first position, the hanger hook curved end being located above a top side of the hinged end of the left arm, and in the second position, the hanger hook curved end being located below the top side of the hinged end of the left arm inside an opening and recess in the hinged end of the left arm.

19. The collapsible hanger of claim 18, wherein the recess comprises a recess region extending inside the left arm from the opening at the hinged end of the left arm to an externally accessible opening at a bottom side of the left arm, and wherein with the curved end of the hanger hook inside the opening and recess and the hanger hook rotated to the second position, the curved end of the hanger hook being externally accessible through the opening at the bottom side of the left arm to apply an external rotational force to the hanger hook thereby rotating the hanger hook around the ball and socket arrangement at the left arm releasing the hanger hook from the second position and rotating the curved end of the hanger hook outside of the opening and recess at the hinged end of the left arm.

20. The collapsible hanger of claim 18, wherein the clasp comprising a curved end portion of the pin overhanging, in close proximity to, the outer surface of the hinge to form the clasp therewith, the clasp for securely holding the collar of the garment to the hinged ends of the hanger arms of the collapsible hanger.

* * * * *